United States Patent [19]

Dyett et al.

[11] Patent Number: 4,483,349

[45] Date of Patent: Nov. 20, 1984

[54] FILTER CIGARETTE MAKING MACHINE

[75] Inventors: Derek H. Dyett; John K. Horsley, both of High Wycombe, England

[73] Assignee: Molins Limited, London, England

[21] Appl. No.: 238,038

[22] Filed: Feb. 25, 1981

[30] Foreign Application Priority Data

Feb. 26, 1980 [GB] United Kingdom ..... 8006365

[51] Int. Cl.[3] ..... A24C 5/47

[52] U.S. Cl. ..... 131/94; 131/282

[58] Field of Search ..... 131/280, 282, 93, 283, 131/94, 95, 84 B, 84 C, 84 R, 105

[56] References Cited

U.S. PATENT DOCUMENTS

| | | | |
|---|---|---|---|
| 3,080,871 | 3/1963 | Molins et al. | 131/94 |
| 3,164,242 | 1/1965 | Schubert et al. | 131/94 |
| 3,164,243 | 1/1965 | Rudszinat et al. | 131/94 |
| 3,212,507 | 10/1965 | Schubert | 131/94 |
| 3,308,832 | 3/1967 | Stelzer et al. | 131/94 |
| 3,308,833 | 3/1967 | Dearsley | 131/94 |
| 3,452,758 | 7/1969 | Gemmell | 131/94 |
| 3,665,930 | 5/1972 | Gratti | 131/94 |
| 3,815,612 | 6/1974 | Molins | 131/94 |
| 4,040,430 | 8/1977 | Molins | 131/94 |
| 4,055,192 | 10/1977 | Berlin et al. | 131/84 B |
| 4,197,864 | 4/1980 | Molins | 131/94 |

*Primary Examiner*—V. Millin

*Attorney, Agent, or Firm*—Antonelli, Terry & Wands

[57] ABSTRACT

A filter attachment machine includes a fluted drum which is arranged to receive double filters and double cigarettes. A knife cuts the double cigarettes through the middle to form separate cigarette portions and, with the aid of a further drum, the two cigarette portions associated with each double filter are swopped in position so as to lie at opposite ends of the double filter, displacement of one of the cigarette portions being achieved preferably by displacing the associated double filter which in turn pushes the cigarette portion. The double cigarettes may be delivered axially into the flutes of the first drum from a cigarette making machine, preferably after delivery of the double filters which can then serve as resilient buffers for the incoming double cigarettes.

14 Claims, 15 Drawing Figures

FILTER CIGARETTE MAKING MACHINE

Filter cigarettes are commonly made by joining two cigarette portions to opposite ends of a double filter. The resulting double filter cigarette is then cut in half to form two individual filter cigarettes.

U.S. Pat. No. 3,815,612 describes a system in which double cigarettes are initially delivered to a fluted drum by a cigarette making machine and are then cut through the middle while being carried by the drum to form two rows of separate cigarette portions; these two rows are then "swopped" in position before cigarettes from the respective rows are joined to opposite ends of interposed double filters. In this way, the visible ends of the finished filter cigarettes are produced by the cutting operation carried out on the fluted drum, rather than being formed by the cut-off device of the cigarette making machine which cuts the continuous axially moving cigarette rod.

The present invention is concerned with a different "swopping" system.

In this context the following terms are intended to have the following meanings: "double cigarette" refers to a rod containing tobacco and/or other smokable material and having a length which is twice that which is required to form one filter cigarette; a "cigarette portion" is half the length of a double cigarette, being sufficient to form a filter cigarette when joined to a filter portion; and a double filter is twice the length of a filter portion.

According to one aspect of this invention, a filter attachment machine includes a first fluted drum having an odd number of flutes, means for feeding double cigarettes into alternate flutes of the first fluted drum, means for cutting each double cigarette through the middle to form two separate cigarette portions, a second fluted drum which is arranged to rotate at the same speed as the first fluted drum and to receive one of the cigarette portions from each alternate flute of the first drum, and means for displacing the cigarette portions along the flutes of the first or second fluted drum whereby, after one revolution of each of the drums, the two portions of each double cigarette are brought together in swopped positions.

This arrangement has the advantage, in particular, that any slight inaccuracy in cutting one of the double cigarettes (i.e. so as to produce cigarette portions of slightly differing lengths) would not affect the length of any completed double filter cigarette. That is because each double filter cigarette is formed by joining the swopped portions of one double cigarette to opposite ends of a double filter.

A preferred arrangement according to this invention includes means for feeding a double filter into alignment with each double cigarette (either before or after the double cigarette is cut through the middle), the displacement of one portion of each double cigarette being effected by displacement means (e.g. an air jet or mechanical guide) acting on the corresponding double filter which in turn pushes the corresponding cigarette portion. By that means, damage to the cigarette portions while they are being displaced into the desired swopped positions is minimised.

The second fluted drum may form an intermediate conveying drum between the first fluted drum and a further fluted drum which is arranged to receive the swopped cigarette portions. In that case, the second fluted drum should have an odd number of flutes equal to the number of flutes formed in the first fluted drum, whereby one portion of each double cigarette is first transferred from the first fluted drum and is followed by the other portion of the same double cigarette after one complete revolution of both drums. This arrangement involves the use of the minimum number of drums.

As an alternative, the second fluted drum may form a bypass from the first fluted drum, being arranged to receive one portion of each double cigarette from the first fluted drum and then to return that cigarette portion to the first fluted drum after one revolution of both drums.

According to another aspect of this invention, a filter attachment machine includes a fluted assembly drum arranged to receive double cigarettes, means for cutting the double cigarettes through the middle to produce separate cigarette portions, an intermediate drum which is arranged to receive from the assembly drum first one portion of each double cigarette, and to receive the other portion after one complete revolution of the assembly drum, and including means for axially displacing the cigarette portions along the assembly drum or intermediate drum whereby the ends of the cigarette portions formed by the said cutting means will form the visible ends of the completed filter cigarettes.

This has the advantage, compared with the arrangement described in U.S. Pat. No. 3,815,612, of avoiding the need for an additional drum (drum 3 in the U.S. patent) serving as a bypass from the assembly drum (drum 1) and from which the swopped cigarette portions need to be transferred back into the relatively deep flutes of the assembly drum.

In a preferred machine according to this aspect of the invention, the assembly drum preferably has an odd number of flutes and is arranged to receive the double cigarettes in alternate flutes. After they have been cut into separate cigarette portions, one of the portions of each double cigarette (possibly together with an associated double filter portion) is transferred into alternate flutes of the intermediate drum, which has an odd number of flutes preferably equal to the number of flutes in the assembly drum. The other cigarette portion (with the filter portion, assuming it was not transferred) recirculates on the assembly drum for one revolution and is then transferred to the intermediate drum to match up with a cigarette portion which has recirculated on the intermediate drum.

During recirculation on the assembly drum or intermediate drum, one of the cigarette portions (preferably together with an associated filter portion) is moved along the flute so as to produce a swopped arrangement of the cigarette portions. In a preferred arrangement, this movement is achieved by air jets or other displacement means acting on the filter portions which in turn push the associated cigarette portions. Each assembly consisting of a cigarette portion, a double filter and another cigarette portion is then transferred from the intermediate drum to a further drum.

Preferably the double filters are delivered on to the assembly drum before the double cigarettes, which may enter the flutes axially in the usual way (e.g. as described in our U.S. Pat. No. 3,667,587). Alternatively, however, the double filters may, instead, be delivered directly on to the intermediate drum; in that case, it is preferably the cigarette portion on the intermediate drum that is axially displaced by pushing or blowing on the double filters in order to protect the cigarette portions themselves from the effect of air jets or other displacement means acting directly on them.

The preferred arrangement described above may, for convenience, be termed a recirculation system in that a complete cycle takes two revolutions of the assembly drum and in that cigarette portions remain on the assembly drum for more than one revolution. An alternative arrangement, which does not involve recirculation, is as follows. A filter attachment machine comprises a fluted assembly drum, means for delivering a double cigarette into each flute of the assembly drum at a cigarette entry station which is preferably downstream of a station at which a double filter is inserted into each flute of the assembly drum, means for cutting each double cigarette while it is on the assembly drum, and means for transferring to a second (intermediate) drum a portion of each double cigarette together with the double filter and a portion of the double cigarette received in that flute during the previous revolution of the assembly drum. With this non-recirculation arrangement, each cigarette/filter/cigarette assembly comprises cigarette portions which are cut from different double cigarettes.

Examples of machines according to this invention are shown in the accompanying drawings. In these drawings.

Figure 1:
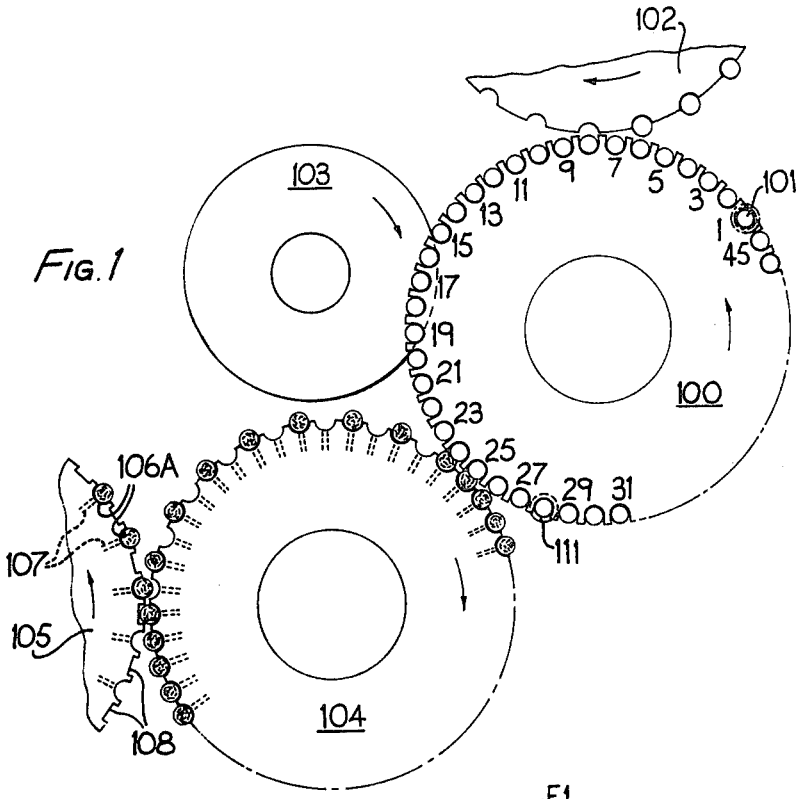
FIG. 1 is a diagrammatic elevation of one preferred machine.

The machine shown in FIG. 1 includes an assembly drum 100 having forty-five circumferentially spaced axial flutes of which the depth is substantially equal to a cigarette diameter. This drum is arranged to receive axially delivered double cigarettes at a delivery station 101. The double cigarettes may be delivered in the manner described in our above-mentioned U.S. Pat. No. 3,667,587. Alternatively, any other means may be used for delivering double cigarettes, e.g. as described in U.S. Pat. No. 3,303,926.

The double cigarettes are delivered into alternate flutes of the drum 100. For convenience, the forty-five flutes have been numbered in FIG. 1, from 1 to 45, the flute adjacent to the delivery station 101 being No. 1.

A filter delivery drum 102 is arranged to deliver double filters into alternate flutes of the assembly drum 100. As will be explained with reference to FIG. 2, at this stage in the rotation of the assembly drum, the double filters are being delivered into even-numbered flutes. In general each flute, after receiving a double cigarette, passes the drum 102 once without receiving a double filter.

A rotating disc knife 103 cuts the double cigarettes in half in the region occupied by flutes 16 to 19. Afterwards, at a transfer point lying between flutes 24 and 25, one of the portions of each double cigarette is transferred onto an intermediate drum 104 which also has forty-five flutes and rotates at the same speed as the assembly drum 100.

Finally, the swopped cigarette portions with interposed double filters are transferred to a receiving drum 105. This drum has only twenty-four operative flutes 106 which are equipped with suction passages 107 to grip the filter and cigarette portions delivered into those flutes. Between the flutes 107 there are dummy flutes 108 to allow clearance for the recirculating cigarette portions on the intermediate drum 104 while at the same time preventing those recirculating cigarette portions from leaving the drum 104.

The operation of the machine will now be described with reference to FIG. 2.

Figure 2:
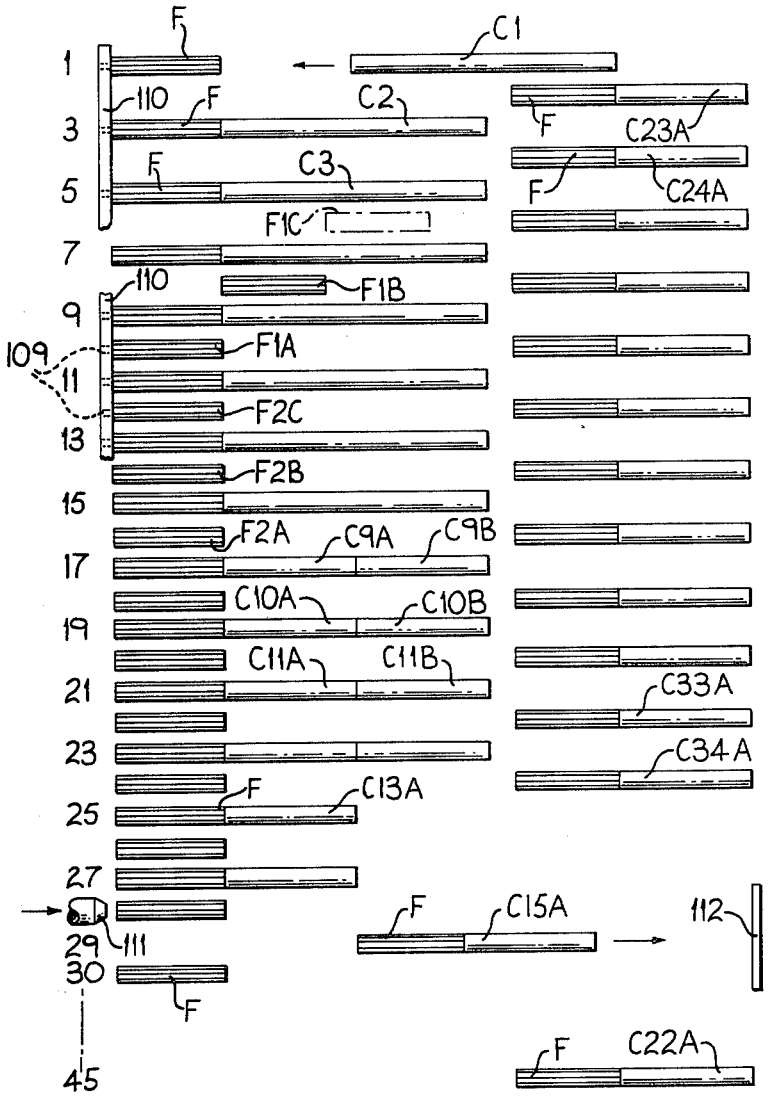
FIG. 2 is a developed view of the assembly drum in the machine shown in FIG. 1.

FIG. 2 is a flat developed view of the surface of the drum 100 in FIG. 1 at one moment in time. Each of the flutes is numbered as shown in FIG. 1. As already explained, the flute 1 is at the cigarette delivery station 101 shown in FIG. 1; flute 8 is adjacent to the filter delivery drum 102; flutes 16 to 19 are in the area of the disc knife 103; and flute 24 is nearly at the intermediate drum 104.

The filter delivery drum 102 delivers double-length filter portions F1A, B and C etc in staggered formation. This is a matter of convenience, the drum 102 being for example the equivalent of the drum 26 of the filter feeding apparatus described in our U.S. Pat. No. 3,405,579; such an arrangement has been used in the Molins PA8 filter attachment machine. In the region of the flutes 10 to 13, suction is transmitted (via a sleeve valve inside the drum) to suction ports 109 in an end stop 110 to suck all the double filters to the left-hand end of the drum so that they clear the knife. The end stops are shown diagrammatically as one member, but would in practice comprise separate parts secured in the respective flutes, preferably with provision for adjustment of their positions along the flutes.

Beginning at flute 1, a double cigarette C1 is seen entering the flute, which had previously received a double filter F now lying at the left-hand (rear) end of the flute (as in the case of the filter in flute 30), as will be explained. Suction ports in the flutes decelerate the double cigarettes in the usual way (e.g. as described in our U.S. Pat. No. 3,667,587). The rate of deceleration is such that each double cigarette comes to rest substantially at the downstream end of the flute, and is sucked onto the corresponding double filter by suction applied through the port 109; a double cigarette C2, C3 or C4 etc with its associated double filter F is shown in that position in each of the flutes 3, 5, 7 etc. The delivery of double cigarettes is appropriately timed so that successive double cigarettes enter alternate flutes in the drum 100.

During further rotation of the drum 100, the double cigarettes C1, C2 etc are cut through the middle by the disc knife 103 (FIG. 1). It will be seen that the double cigarettes in flutes 17, 19 etc have been cut in that way to form separate cigarette portions C9A and B, C10A and B etc.

Considering still only the odd-numbered flutes, flute 25 has just passed the point at which one of the cigarette portions remote from the associated double filter has been transferred to the intermediate drum 104, leaving in the flute 25 only the double filter F and the abutting cigarette portion C13A. The other half (C13B) of the double cigarette C13 recirculates through one revolution on the drum 104 before being again brought together with the cigarette portion C13A and the associated double filter, which are transferred to the drum 104 in the desired swopped positions, as occupied by the cigarette portions C23A, C24A etc, with their abutting double filters F in flutes 2, 4 etc.

Soon after the B halves of the double cigarettes have been transferred to the drum 104, an air jet from a nozzle 111 (or from a series of nozzles) blows the cigarettes and filters towards the front end of the drum (i.e. the right-hand end as seen in FIG. 2); cigarette portion C15A and its associated double filter F in flute 29 is seen moving in that way. A fixed wall 112 adjacent to the right-hand end of the drum 100 in that region serves as a stop, limiting movement of the cigarette portions and filters so that they arrive at the positions occupied by cigarette portion C22A in flute 45, and by cigarette portions C23A and C24A in flutes 2 and 4 which have begun to recirculate on the drum 100. The bottoms of the flutes of the drum 100 may, near the right-hand ends, have ports through which suction is applied in the region occupied by flutes 28 to 32 to grip the cigarette portions when they reach the wall 112, i.e. to prevent them from striking the wall 112 and bouncing back.

The air jet 111 is pulsed so as not to displace the lone double filters present in the alternate flutes.

The presence of the double filters in the flutes provides resilient buffers for the incoming double cigarettes: Furthermore, it is important to note that displacement of the cigarette portions for the purpose of swopping is achieved by pushing (blowing on) the filter portions, rather than by pushing the cigarette portions themselves directly.

On again reaching the intermediate drum 104 (after recirculating on the drum 100) the "swopped" cigarette portions and their associated double filters are each transferred to the drum 104 so as to be brought together with the other half of the same double cigarette which has recirculated through one revolution on the intermediate drum 104. The "swopped" cigarette/filter/-cigarette assemblies are then transferred to the receiving drum 105, on which they are pushed together prior to being joined by a uniting band in a well-known manner.

With further reference to FIG. 2, cigarette portion C34A and its associated double filter are about to be transferred to the drum 104. The cigarette portion and double filter in the preceding flute 26 have already been so transferred.

It will be understood that the flutes of the intermediate drum 104 in the lower region of the drum are occupied alternately by complete assemblies and by recirculating B halves of the double cigarettes. In the upper region of the drum 104, alternate flutes carry the recirculating B halves of the double cigarette portions, and the other flutes are empty.

Figure 3:
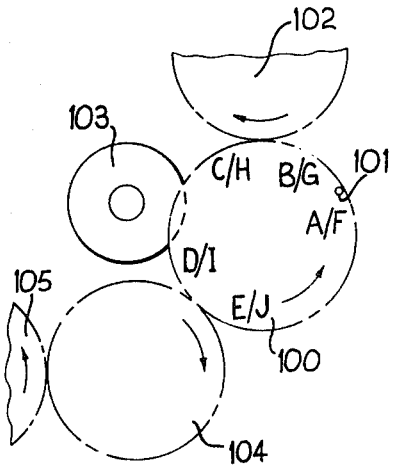
FIG. 3 shows diagrammatically the same arrangements of drums shown in FIG. 1.
Figure 4:
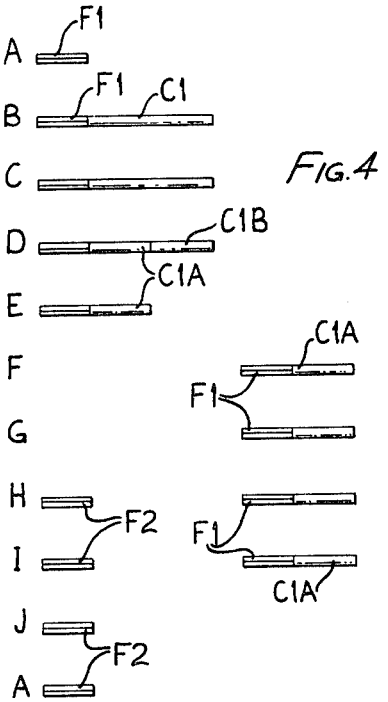
FIG. 4 shows the sequence of events occurring in one flute of the assembly drum at various stages (during two revolutions) identified by letters in FIG. 3.

The operation of the system shown in FIGS. 1 and 2 is further illustrated by FIGS. 3 and 4, which show diagrammatically a complete cycle of events in one flute of the assembly drum 100. For that purpose, FIG. 4 is a flat developed view showing the sequence of events occurring in one flute of the assembly drum at stages indicated by the letters A to H in FIG. 3. This represents one complete cycle.

At the beginning of the cycle shown in FIG. 4 (stage A) there is a double filter F1 in the flute. At the cigarette delivery station 101, a double cigarette C1 enters the flute axially from the right and slides into abutment with the double filter F1 (stage B). During this revolution of the drum 100, no double filter is inserted into the flute, so that stage C is identical to stage B. At stage D the double cigarette has been cut by the knife 103 into two cigarette portions C1A and C1B. Cigarette portion C1B is transferred to the intermediate drum 104 (stage E), after which the double filter F1 and cigarette portion C1A are blown to the right-hand end of the flute (stage F).

During the second revolution of the drum 100, no cigarette portion is inserted into this flute, so that stage G is identical to stage F. However, a second double filter F2 is inserted by the drum 102 (stage H). The knife 103 has no effect during this revolution, so that stage I is the same as stage H. On reaching the intermediate drum 104, the double filter F1 and cigarette portion C1A are transferred to the intermediate drum to be brought together with the cigarette portion C1B. Afterwards (stage J) the filter portion F2 remains in the flute to begin another cycle at stage A.

When a machine according to FIG. 1 is being started, the delivery of double filters to the assembly drum is preferably arranged to begin before double cigarettes arrive on the assembly drum, so that the first double filter portion joins up with the first double cigarette, thus avoiding any waste.

In principle, the double filters could be delivered directly on to the intermediate drum 104. However, it is preferable to make the double filters available to act as buffers for the double cigarettes entering the assembly drum 100 and to assist in protecting the A halves of the cigarette portions during the "swopping" move, as already described.

Another modification which is possible in principle is as follows. Instead of the B halves of the cigarette portions being first transferred to the intermediate drum 104, the A halves together with the associated double filters may be transferred to the intermediate drum, leaving the B halves to recirculate on the assembly drum 100. In that case, one or more jets or other displacement means would be provided adjacent to the intermediate drum 104 (e.g. the upper half thereof) to displace the cigarette portions and filters in the direction necessary for swopping.

Instead of the initial multiple-length filter rods being "six-up" (i.e. long enough to produce six individual filters), they may be "four-up". The groups transferred to the assembly drum 100 by the drum 102 would in that case each comprise two staggered double filters.

As already mentioned, the assembly drum 100 may be basically in accordance with the drum 2 of our U.S. Pat. No. 3,667,587, i.e. may include a cowl to assist in controlling the deceleration of the double cigarettes as they move axially along the flutes of the drum 100. In order to ensure that each double cigarette is in abutment with the corresponding double filter (to ensure that it is cut through the middle by the knife 103), the cowl around the assembly drum may have oblique air inlets for directing jets or air towards the right-hand ends of the double cigarettes; air at slightly above atmospheric pressure may be supplied to the air inlets. Similarly, oblique air inlets may be provided in the cowl to blow directly on to the left-hand ends of the filters, e.g. in the region of the flute 22 to ensure that the filters and associated cigarette portions have moved far enough to the right to enter the flutes of the intermediate drum 104 with slight clearance with respect to the B halves of the cigarette portions already in the flutes of the drum 104. Alternatively either positioning operation may be achieved by a fixed guide extending tangentially into a circumferential groove in the drum 100 so as to push the double cigarette or double filter slightly along its flute if necessary.

It will be understood that the drums 100 and 104 have internal suction manifolds for applying suction to ports in the flutes so as to hold the cigarettes/filters in the flutes when necessary and to release the suction from the flutes when necessary to allow a transfer.

In the example shown in FIG. 3, the following modification is possible. Instead of the double cigarettes being delivered directly to the drum 100, they may be delivered to the drum 102 after receipt by that drum of double filters in the same flutes which then receive the double cigarettes.

Figure 5:
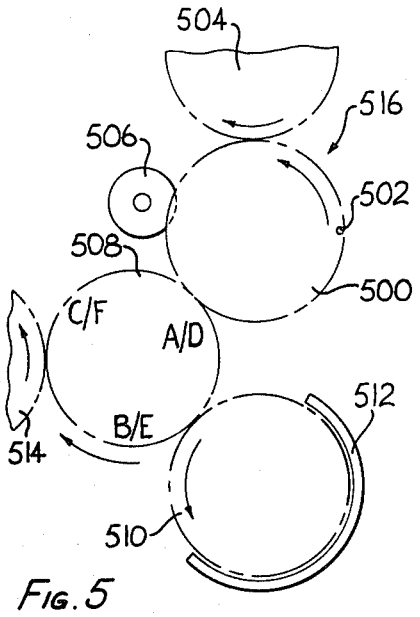
FIG. 5 shows diagrammatically a different arrangement in which the sequence of events in one flute of the main drum are shown in FIG. 6.
Figure 6:
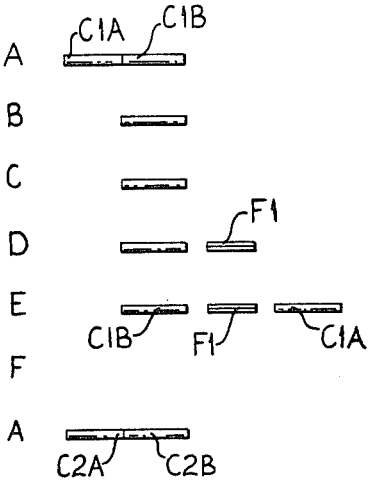

FIGS. 5 and 6 illustrate, in the same manner as FIGS. 3 and 4, the operation of a different arrangement according to this invention. Double cigarettes are delivered axially to a fluted drum 500 at a delivery station 502. The cigarettes enter alternate flutes in the drum 500, the intervening flutes being arranged to receive only double filter portions from a drum 504. A knife 506 cuts the double cigarettes in half prior to their transfer into alternate flutes in a drum 508.

One portion of each double cigarette is transferred from the drum 508 to a swopping drum 510 and is then axially displaced by a cowl 512 so as to arrive back on the drum 508 in a swopped position relative to the other portion of the same double cigarette which has meanwhile been carried around the drum 508 through one complete revolution. The drums 508 and 510 rotate at the same speed; they may have the same number of flutes, e.g. forty-five.

FIG. 6 shows the sequence of events in one flute of the drum 508. At stage A it is assumed that the relevant flute has not yet received a double filter but will do so after one further revolution of the drum 508. Accordingly, the flute contains only the two portions C1A and C1B of a double cigarette. At stage B, the cigarette portion C1A has been transferred to the swopping drum 510. No transfer from this flute to a further fluted drum 514 takes place during this revolution of the drum 508, as shown by the stage illustration C in FIG. 6. At stage D, the flute has received a double filter F1 and then receives the swopped cigarette portion C1A, as shown by stage illustration E. The complete assembly consisting of the swopped cigarette portions C1A and C1B and the double filter F1 is then transferred to the drum 514, and immediately before stage A the flute again receives a pair of cigarette portions C2A and C2B. Thus the cycle repeats.

It should be understood that the double filters do not circulate around the drum 508 but are instead transferred from the drum 508 to the further drum 514 at the first opportunity. This is illustrated in FIG. 6 by the fact that a double filter F1 is shown only at stages D and E.

Figure 7:
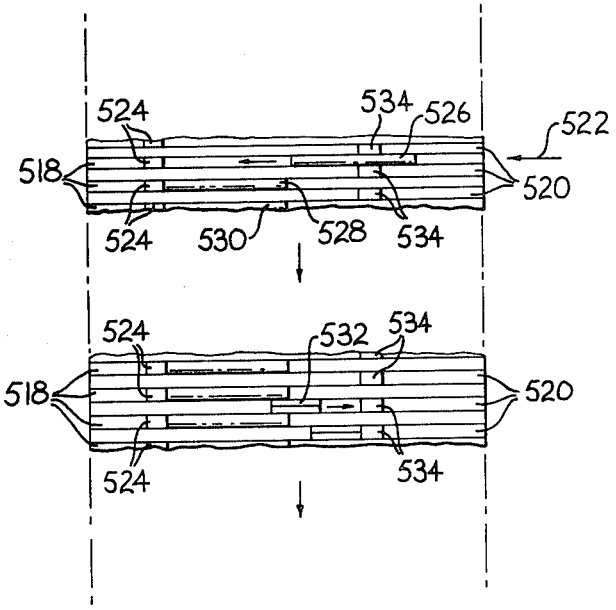
FIG. 7 shows a detail of one of the drums shown in FIG. 5.

FIG. 7 is a flat developed view of part of the upper half of the fluted surface of the drum 500 in FIG. 5. Each flute of the drum 500 is designed to receive only double cigarettes or only double filters. There are, for example, twenty-two flutes of the first type and twenty-two of the second type, making a total of forty-four flutes. Flutes of the first type (for receiving double cigarettes) are identified by the reference numeral 518 in FIG. 7, the other flutes being identified by the numeral 520. Double cigarettes are delivered axially in the direction of the arrow 522 so as to enter successive flutes 518. Each double cigarette passes along the flute until it reaches an end stop 524 which locates the adjacent end of the cigarette in the correct position prior to cutting by the knife 506 (FIG. 5). The stops may contain or be located adjacent to suction ports whereby the cigarettes are sucked against the stops. FIG. 7 shows one cigarette unit 526 moving along the corresponding flute 518, preceding cigarettes 528 and 530 having already come to rest adjacent to corresponding stops 524.

Double filters 532 may be delivered into the flutes 520 at various staggered positions and are then sucked to the right on to the stops 534.

An advantage of the arrangement described in FIGS. 5 to 7 lies in the fact that the flutes of the drum 500 can each be designed specially to receive double cigarettes or double filters in the most effective way. Furthermore, the function of catching of double cigarettes is separated from the swopping function. However, compared with FIGS. 1 to 4, an additional drum is needed.

Figure 8:
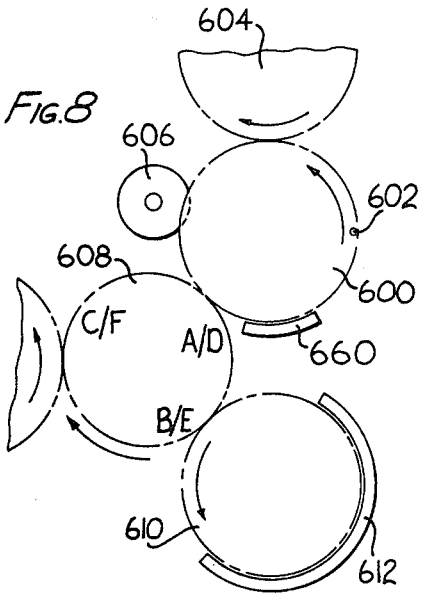
FIG. 8 shows diagrammatically a different arrangement in which the sequence of events in one flute of the main drum are shown in FIG. 9.
Figure 9:
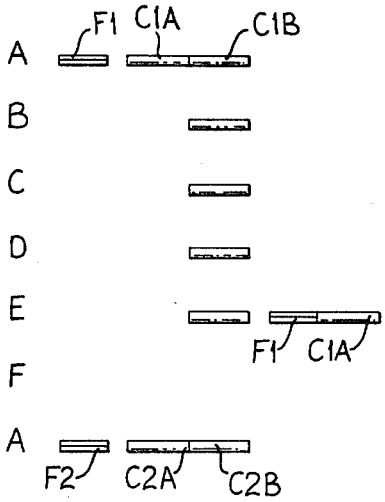
Figure 10:
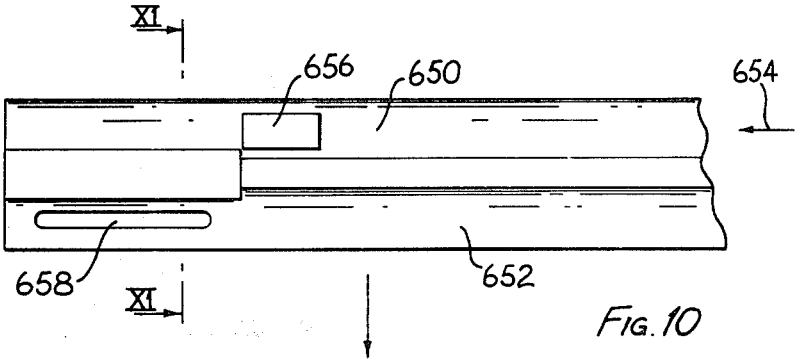
FIG. 10 shows a detail of one of the drums shown in FIG. 8.

FIGS. 8 to 10 show a modification of the arrangement shown in FIGS. 5 to 7. Double cigarettes are again delivered into alternate flutes in a drum 600 respectively at delivery station 602 and by drum 604. A knife 606 cuts the double cigarettes through the middle, after which they are transferred into alternate flutes in a drum 608 having an odd number of flutes. In contrast with the previous example, the double filters are rolled back from their initial flutes and into the flutes of the drum 600 containing the double cigarettes (as described below). Therefore, alternate flutes of the drum 608 receive double filters together with the pairs of cigarette portions. Thus at stage A in FIG. 9, the flute contains a pair of cigarette portions C1A and C1B and a double filter F1. Immediately before stage B, the cigarette portion C1A is transferred to a swopping drum 610 together with the double filter F1. A cowl 612 retains the cigarette portion C1A and filter F1 on the drum 610 while pushing the filter F1 towards the opposite end of the drum, and the filter in turn pushes the cigarette portion C1A. Thus, after one revolution of the drums 608 and 610, the filter F1 and cigarette portion C1A are returned to the flute of the drum 608 containing the corresponding cigarette portion C1B (see FIG. 9, stage E).

Apart from the differences already mentioned, the arrangement described in FIGS. 8 and 9 operates in the same manner as that shown in FIGS. 5 and 6.

FIG. 10 is a plan view of part of the drum 600 and shows how the double filters can be rolled back into the flutes of the drum 600 containing the double cigarettes. FIG. 10 shows only two flutes, namely a flute 650 which is arranged to receive double cigarettes, and a flute 652 which is arranged to receive double filters. Double cigarettes enter alternate flutes of the drum 600 (e.g. flute 650) from the right, i.e. in the direction of the arrow 654. A stop 656 near the end of the flute determines the position of the cigarette end during cutting.

As already described, the stop may include a suction port or may be associated with a suction port in the flute whereby the double cigarette is drawn against the stop. Double filters may be delivered into their corresponding flutes (such as flute 652) at various positions and may then be blown or sucked to the left-hand end of the flute at which each double filter portion (not shown) lies over a suction port 658. Suction applied through the port 658 holds the filter portion on the drum 600 as it passes the drum 608 for the first time. A set of rolling fingers 660 then rolls the double filter backwards and into the flute 650 which is about to receive a double cigarette at the delivery station 602. On again reaching the drum 608, the double filter is transferred to the drum 608 together with the aligned cut double cigarette, as already mentioned. After being rolled back into the flute 650, and before being transferred to the drum 608, the double filter is held in the flute 650 by a fixed guide (not shown) extending around the drum 600.

The end stops 656 may be omitted to allow the double filters to act as buffers receiving the impact of the double cigarettes.

Figure 12:
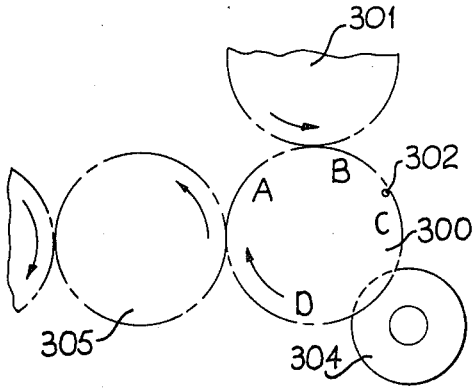
FIG. 12 shows diagrammatically a different (non-recirculation) arrangement in which the sequence of events in one flute of the main drum are shown in FIG. 13.
Figure 13:
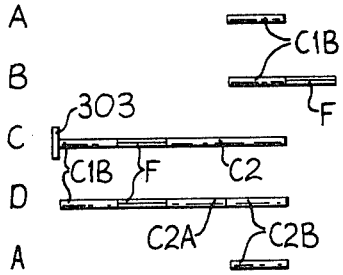

FIGS. 12 and 13 illustrate, in the same manner as FIGS. 3 and 4, the operation of a swopping system without recirculation. A complete cycle occurs during one revolution of an assembly drum 300. Each flute of the assembly drum 300 at stage A contains a cigarette portion C1B which comprises half the double cigarette received in that flute during the previous revolution. At stage B, a double filter F has been inserted by a filter delivery drum 301. A double cigarette C2 is delivered axially into the flute, from the right-hand end, at a cigarette delivery station 302, and pushes the double filter F and cigarette portion C1B to the left-hand end of the flute (stage C) against an end stop 303. At stage D, a knife 304 has cut the double cigarette into two portions C2A and C2B. A further (intermediate) drum 305 then receives the assembly comprising cigarette portion C1B, double filter F and cigarette portion C2A, and a further cycle then begins with the remaining cigarette portion C2B.

In the event of a double filter being missing, the double cigarette C2 would move too far to the left and would not be cut in the middle. The resulting fault would be perpetuated unless corrective measures are taken. For example, there may be provision to detect a missing filter and to replace it at any convenient point on the assembly drum. That would ensure that the fault is not perpetuated.

Figure 14:
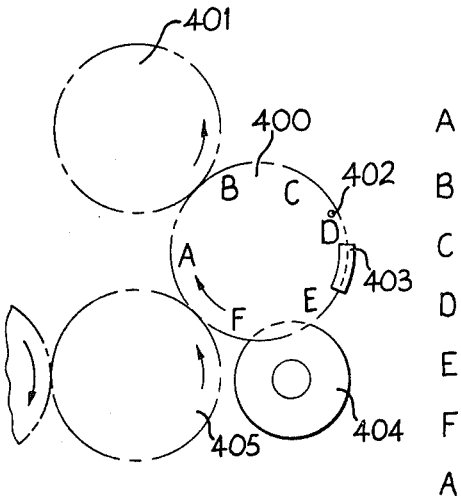
FIG. 14 shows diagrammatically another different (non-recirculation) arrangement in which the sequence of events in one flute of the main drum are shown in FIG. 15.
Figure 15:
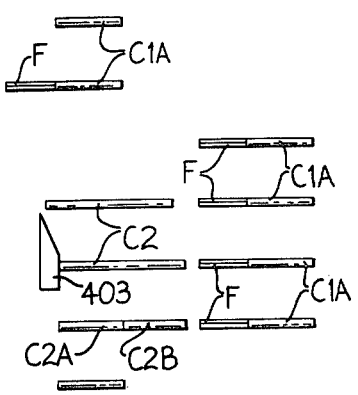

FIGS. 14 and 15 show a modification of the system shown in FIGS. 12 and 13. At stage A each flute of assembly drum 400 contains a cigarette portion C1A which is half of the double cigarette received in that flute during the previous revolution of the assembly drum. At stage B, the flute has received a double filter F from a filter delivery drum 401. Between stages B and C, an air nozzle is arranged to blow the double filter F and cigarette portion C1A to the right-hand end of the flute as seen in FIG. 19. At a cigarette delivery station 402, a double cigarette C2 is inserted into the flute by means of a positive transfer device, e.g. as described in U.S. Pat. No. 3,303,926. Between stages D and E there is a plough member 403 which extends into a circumferential groove in the drum 400 and has an inclined surface arranged to move the double cigarette C2 slightly to the right to position it accurately in preparation for cutting in half by a knife 404. At stage F, the double cigarette C2 is in two portions C2A and C2B. A further (intermediate) drum 405 then receives the assembly comprising cigarette portions C1A and C2B and double filter F, and the cycle then repeats.

In FIG. 1 the pulsing of the air jet 111 through the ports or passages 109 maybe achieved as follows. A timing ring is arranged to rotate adjacent to the end portion 110 of the drum 100, being coaxial with the drum 100 and having a slightly different speed of rotation whereby passages through the ring allow alternate passages 109 to communicate with a compressed air manifold adjacent to the ring. For example, the ring may have 22 passages at circumferentially evenly spaced intervals, in which case it is preferably driven at a speed bearing a ratio of 45:44 with respect to the speed of the drum 100. By that means, jets of air may be directed several times into each flute containing a double filter and an abutting cigarette portion (e.g. flutes 29, 31, 33 etc in FIG. 2) to displace those items along the flutes without blowing into the intervening flutes. This arrangement for transmitting pressure (or suction) to alternate flutes of a drum having an odd number of flutes may be used for other purposes, e.g. where selective transfer of cigarettes or filters is required from alternate flutes, as in the transfer from drum 104 to drum 105 in FIG. 1.

Figure 11:
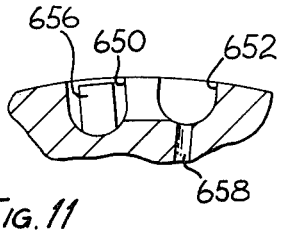
FIG. 11 is a section on the line XI—XI in FIG. 10.

With regard to the example shown in FIGS. 8 to 11, instead of the double filters being rolled back into alignment with the double cigarettes on the drum 600, such rolling back may occur on the drum 668 between stage A and the transfer to the drum 610, or possibly on the drum 610 itself prior to arrival at the cowl 612. In either case, the drum on which rolling back occurs would be cut away in the appropriate areas (as shown in FIG. 11) to allow the double filters to be rolled back, by appropriate fixed rolling means, from one flute to the next adjacent flute.

We claim:

1. In a filter attachment machine, a first fluted drum having an odd number of flutes, means for feeding double cigarettes into alternate flutes of the first fluted drum, means for cutting each double cigarette through the middle to form a pair of separate cigarette portions, a second fluted drum which is arranged to rotate at the same speed as the first fluted drum and to receive one of the cigarette portions of each pair from each alternate flute of the first drum, means for displacing the cigarette portions along the flutes of the first or second fluted drum, and means for transferring one cigarette portion of each pair from one drum to the other drum after one revolution of each of the drums, whereby the two portions of each double cigarette are brought together in swopped positions.

2. A filter attachment machine according to claim 1, including means for feeding a double filter into alignment with each double cigarette, the displacement of one portion of each double cigarette being effected by displacement means acting on the corresponding double filter which in turn pushes the corresponding cigarette portion.

3. A filter attachment machine according to claim 2 including a fluted assembly drum which is arranged to receive double filters and into which the double cigarettes are arranged to be delivered axially from a cigarette making machine to positions in which they abut against the double filters.

4. A filter attachment machine according to claim 3, in which the assembly drum comprises the first fluted drum and has an associated cutting means for cutting the double cigarettes into the separate cigarette portions.

5. A filter attachment machine according to claim 1, 2 or 3, in which the second fluted drum forms an intermediate conveying drum between the first fluted drum and a further fluted drum which is arranged to receive the swopped cigarette portions, the second fluted drum having an odd number of flutes equal to the number of flutes formed in the first fluted drum, whereby one portion of each double cigarette is first transferred from the first fluted drum and is followed by the other portion of the same double cigarette after one complete revolution of both drums.

6. In a filter attachment machine, a fluted assembly drum arranged to receive double cigarettes, means for cutting the double cigarettes on said assembly drum through the middle to produce separate cigarette portions, an intermediate drum which is arranged to receive from the assembly drum first one portion of each double cigarette, and to receive the other portion after one complete revolution of the assembly drum, and including means for axially displacing the cigarette portions along the assembly drum or intermediate drum, whereby the ends of the cigarette portions formed by the said cutting means will be directed away from each other on said intermediate drum.

7. A filter attachment machine according to claim 6, including means for feeding double filters on to the assembly drum.

8. A filter attachment machine according to claim 7, in which each double cigarette is arranged to be delivered axially into a flute of the assembly drum after a double filter has been delivered into that flute, so that the double filter serves as a resilient buffer for the double cigarette.

9. A filter attachment machine according to claim 7 or claim 8, in which displacement of each cigarette portion is achieved by displacement means acting upon the corresponding double filter which in turn pushes the corresponding cigarette portion.

10. A filter attachment machine according to claim 6, in which the assembly drum has an odd number of flutes and is arranged to receive the double cigarettes in alternate flutes, the intermediate drum having the same number of flutes and being arranged to receive cigarette portions from the assembly drum in alternate flutes, and to deliver swopped cigarette portions to a further fluted drum from alternate flutes of the intermediate drum, whereby one portion of each double cigarette is carried by the intermediate drum through one complete revolution, and is brought together with the other portion of the same double cigarette after the latter has been carried around the assembly drum through a complete revolution after which it is delivered to the intermediate drum.

11. A filter attachment machine according to claim 10, in which the further fluted drum has an even number of flutes, alternate flutes having suction ports whereby they are arranged to receive and carry cigarette portions and double filters, and the other flutes being arranged to hold the recirculating cigarette portions on the second fluted drum.

12. A filter attachment machine arranged to receive double cigarettes and double filters in axial alignment and including means for cutting the double cigarettes through the middle to produce two separate cigarette portions either before or after delivery of the double filters; a first drum arranged to carry the double filters and the adjacent cigarette portions while the other cigarette portions are being carried by a second drum; and displacement means adjacent to the first drum for axially displacing the double filters which in turn push the respective cigarette portions, whereby the ends of the cigarette portions formed by the said cutting means will form the tobacco ends of the completed filter cigarettes.

13. A filter attachment machine according to claim 12 in which the first drum and second drum are each arranged to carry the respective cigarette portions through a complete revolution at the same speed whereby the two portions of each double cigarette are brought together again in swopped positions.

14. In a filter attachment machine, a first fluted drum arranged to receive double cigarettes in the flutes thereof, means for cutting each double cigarette through the middle to produce two separate cigarette portions, means for effecting separate transfer of the two portions of each double cigarette from the first fluted drum during successive revolutions of the drum, a second fluted drum which is arranged to receive from each flute of the first drum one portion of each double cigarette together with a portion of the double cigarette received by the said flute of the first drum during the previous revolution of the drum, and including means for axially displacing along the first drum the portion of each double cigarette which is left on the first drum after the other portion of the same double cigarette has been transferred to the second drum, whereby the ends of the cigarette portions formed by the said cutting means will be directed away from each other on said second drum.

* * * * *